US005752557A

United States Patent [19]

Crider et al.

[11] Patent Number: 5,752,557

[45] Date of Patent: May 19, 1998

[54] SEALABLE CURTAIN

[75] Inventors: Grant W. Crider, Bremen; Charles H. Harbison, Birmingham, both of Ala.

[73] Assignee: Hired-Hand Manufacturing, Inc., Breman, Ala.

[21] Appl. No.: 684,992

[22] Filed: Jul. 22, 1996

Related U.S. Application Data

[63] Continuation-in-part of Ser. No. 556,484, Nov. 13, 1995, Pat. No. 5,566,736.

[51] Int. Cl.[6] ..... E06B 9/08

[52] U.S. Cl. ..... 160/121.1; 160/85; 160/265

[58] Field of Search ..... 160/121.1, 85, 160/86, 120, 122, 242, 266, 268.1, 270, 271, 273.1, 84.06, 279, 322, 265, 310

[56] References Cited

U.S. PATENT DOCUMENTS

| | | | |
|---|---|---|---|
| 1,113,721 | 10/1914 | Watson . | |
| 1,309,488 | 7/1919 | Richardson . | |
| 2,281,022 | 4/1942 | Cavanaugh | 160/85 |
| 2,349,368 | 5/1944 | Myers | 160/85 X |
| 3,279,528 | 10/1966 | Gambon et al. | 160/279 X |
| 3,789,904 | 2/1974 | Takazawa | 160/120 |
| 3,980,122 | 9/1976 | Takazawa | 160/85 |
| 4,326,577 | 4/1982 | Tse | 160/279 |
| 4,418,739 | 12/1983 | Woolnough et al. | 160/120 |
| 4,436,137 | 3/1984 | Charles | 160/242 |
| 4,473,101 | 9/1984 | Langeler | 160/84.06 |
| 4,574,864 | 3/1986 | Tse | 160/279 X |
| 4,649,981 | 3/1987 | Bibeau . | |
| 4,744,403 | 5/1988 | Hausmann et al. . | |
| 5,141,044 | 8/1992 | Hying et al. . | |
| 5,195,594 | 3/1993 | Allen et al. . | |
| 5,535,806 | 7/1996 | Kold et al. | 160/279 X |

*Primary Examiner*—David M. Purol
*Attorney, Agent, or Firm*—Veal & Associates

[57] ABSTRACT

An improved roll-up closure utilizing a flexible cover or curtain selected from a material suitable to effect the type of closure sought. The cover is at least as wide as the portal to be covered and is typically longer than the portal. Each lateral margin of the cover has a strip of hook and loop fastener material affixed thereto, and a complementary strip is affixed to the lateral margins of the structure defining the portal. A first end of the cover is rigidly affixed across a first margin of the portal. The opposite end of the cover is upturned and connected to a driven take-up roller mounted to the first margin of the portal. An elongated transverse rod is supported within the upturned end of the cover. Activation of the driven roller lengthens or shortens the effective length of the cover and moves the rod therewith. As the driven roller is activated, the mating hook and loop fasteners are positioned to seal and unseal the cover to the lateral margins of the portal. The rod can either have sufficient weight to maintain tension on the cover such that the cover forms an adequate seal with the lateral margins of the portal, or in the alternative, a spring assembly or a second driven roller can be mounted to a second margin of the portal opposite the first margin to maintain tension on the cover.

13 Claims, 7 Drawing Sheets

FIG. 4
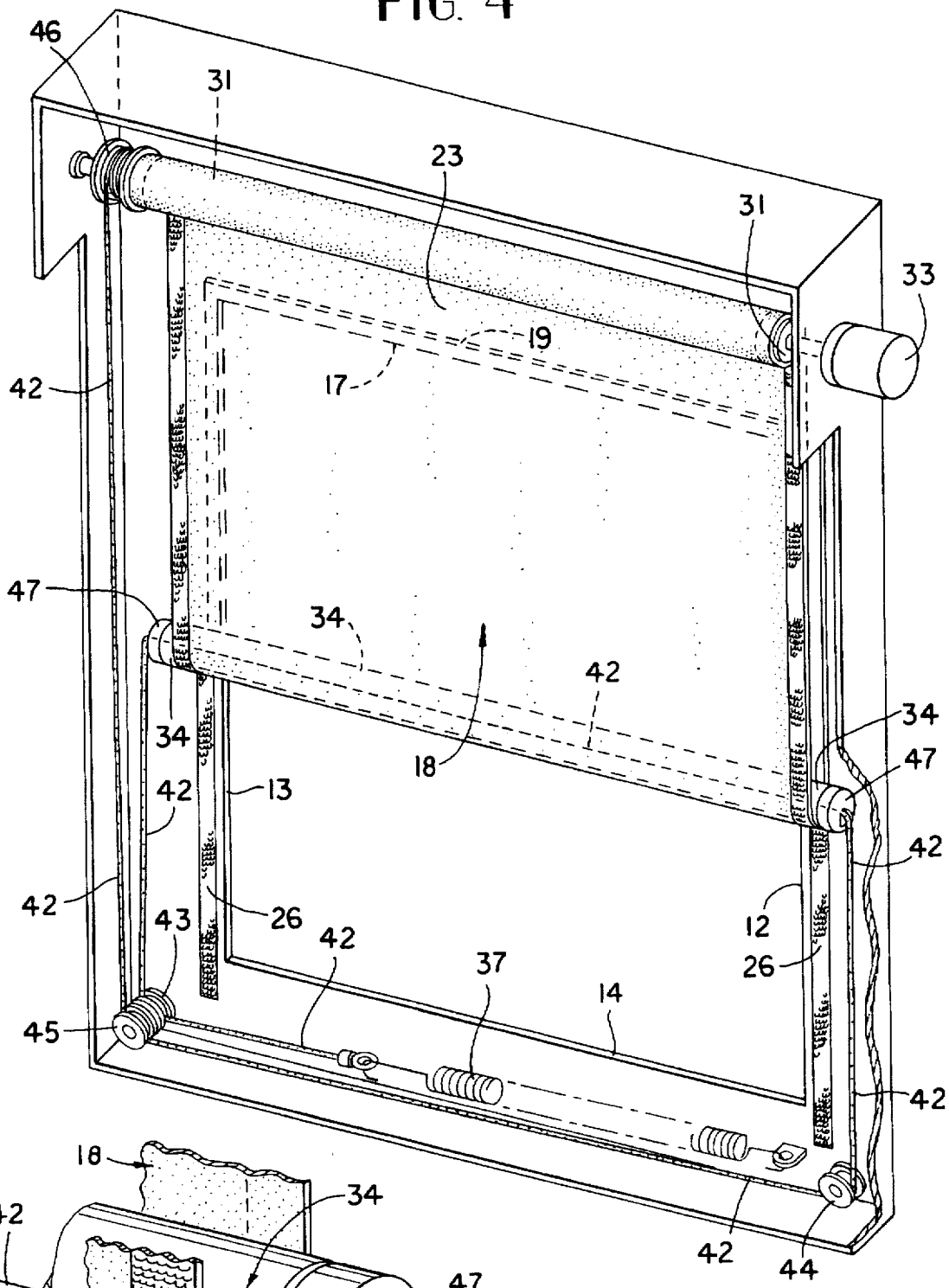
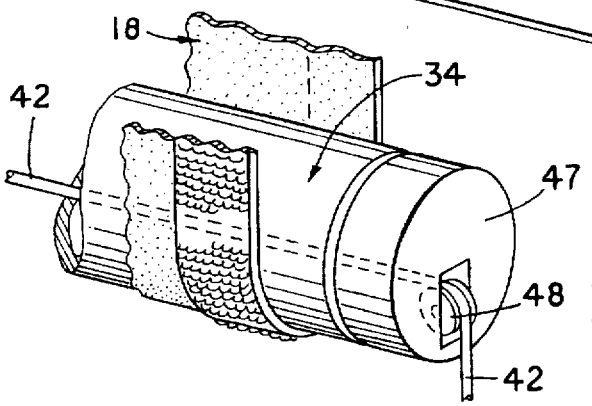
FIG. 4A

SEALABLE CURTAIN

RELATED PATENTS

This application is a continuation-in-part of 08/556,484 filed Nov. 13, 1995, U.S. Pat. No. 5,566,736 issued on Oct. 22, 1996.

FIELD OF THE INVENTION

The present invention relates to the field of closures for windows, doors, or other portals and more particularly to closures which can be selectively positioned. In greater particularity the present invention relates to a non-sliding roll-up closure for a portal.

BACKGROUND OF THE INVENTION

Various applications are known wherein a portal requires a closure, or cover, to prevent the passage of wind, rain, light, insects, or any other elements through the portal. As used herein, portal simply means an opening which would allow the passage of such elements therethrough; hence a portal may be a window and the closure of the instant invention may control the passage of any of the above elements therethrough. The present invention addresses the need for improved closures for portals such as may be found on patios, pool houses, green houses, livestock houses, atriums or any other similar structures. The portal may be as small as would accommodate a ventilation fan in a gymnasium or livestock house, or as large as an atrium wall in a solar efficient building or an inclined roof panel. Additionally, the position of the portal can range from vertical to horizontal or any angle therebetween.

SUMMARY OF THE INVENTION

It is the object of the present invention to provide a means for effectively covering portals such as windows and doors in a number of differing types of buildings.

Another object of the invention is to provide a reliable and easily operated closure for such portals.

These and other objects of the present invention are accomplished through the use of an improved roll-up closure. The closure utilizes a flexible cover or curtain selected from a material suitable to effect the type of closure sought. For example, the cover may be comprised of a material having a weave that would be permeable to air yet block a certain amount of light. Similarly, the cover could be impermeable to moisture yet permeable to air, or numerous other variations to meet the needs of the particular structure on which the closure is used. The cover is at least as wide as the portal to be covered and is typically longer than the portal. Each lateral margin of the cover has a strip of hook and loop fastener material affixed thereto, and a complementary strip is affixed to the lateral margins of the structure defining the portal. A first end of the cover is rigidly affixed across a first margin of the portal. The opposite end of the cover is upturned and connected to a driven take-up roller mounted to the first margin of the portal. An elongated transverse rod is supported within the upturned end of the cover. Activation of the driven roller lengthens or shortens the effective length of the cover and moves the rod therewith. As the driven roller is activated, the mating hook and loop fasteners are positioned to seal and unseal the cover to the lateral margins of the portal. The rod can either have sufficient weight to maintain tension on the cover such that the cover forms an adequate seal with the lateral margins of the portal, for example where the portal covered has an angle greater than 15 degrees above horizontal, or in the alternative, biasing means such as a spring assembly or a second driven roller can be mounted to a second margin of the portal opposite the first margin and utilized to maintain tension on the cover.

These and other objects and advantages of the invention will become apparent from the following detailed description of the preferred embodiment of the invention.

BRIEF DISCRIPTION OF THE DRAWING

A closure embodying features of my invention is described in the accompanying drawings which form a portion of this disclosure and wherein:

FIG. 4 is a rear perspective view of an alternative embodiment of the present invention;

FIG. 4A is an enlarged view of the bearing plug shown in FIG. 4;

DETAILED DISCRIPTION OF THE EMBODIMENT

Figure 1:
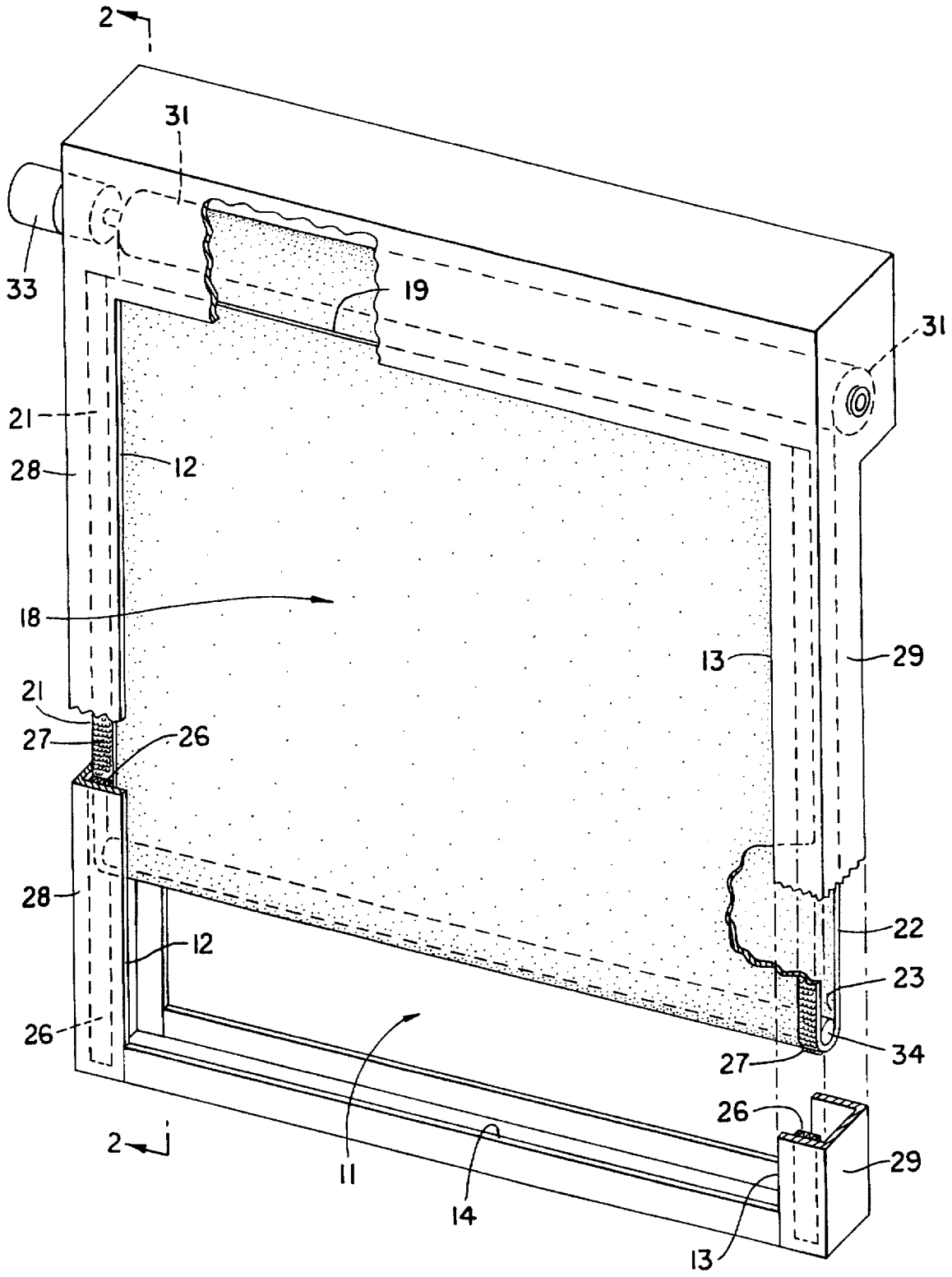
FIG. 1 is front perspective view of the invention in a partially raised position and shown partially in section.

A more complete understanding of the invention may be obtained by reference to the accompanying drawings wherein the closure, according to the preferred embodiment, covers an opening 11 having a pair of lateral margins 12 and 13. Margins 12 and 13 extend the full vertical length of opening 11 and may terminate at a lower margin 14, which extends across the width of the opening. In some applications a sealing gasket 16, such as a compressible layer of a foam-like material will be useful in the bottom of lower margin 14. It is to be understood that the present invention may be positioned vertically, horizontally, or inclined; thus, lower margin does not imply only vertical disposition of the unit. Across the top of opening 11 is an upper margin 17 which extends from margin 12 to margin 13. Thus, it may be seen that the opening is completely framed by margins 12, 13, 14, and 17.

Attached to margin 17 is a first end of a curtain 18, the curtain being comprised of a flexible material selected in accordance with the purposes of the present invention for its ability to block or transmit light, air, moisture, insects, or the like from one side to the other thereof As an air barrier, we have noted that a woven polyester fabric has exhibited good durability having withstood over 60,000 cycles of operation of the invention. However, canvas, other plastics, some metals and fabrics which are selectively permeable are known to exist which may find application in the present invention. Therefore, curtain 18 is properly defined as a flexible barrier material, having a first end 19 secured to margin 17 and opposing longitudinal sides 21 and 22 which are longer than the length of margins 12 and 13 such that curtain 18 has an upturned lower end 23. Attached to margins 12 and 13 and to sides 21 and 22 are complementary closure members 26 and 27. For example, hook and loop fastener material was attached to the polyester fabric used in testing the invention and to the inside of margins 12 and 13 such that sides 21 and 22 could be selectively attached and detached from the margins. Note that the closure members need only be approximately commensurate in length with the length of the margins, thus upturned end 23 of curtain 18 does not need the fastener material. A transverse closure may be provided in conjunction with lower margin 14; however, on a door, margin 14 would not be present.

Figure 2:
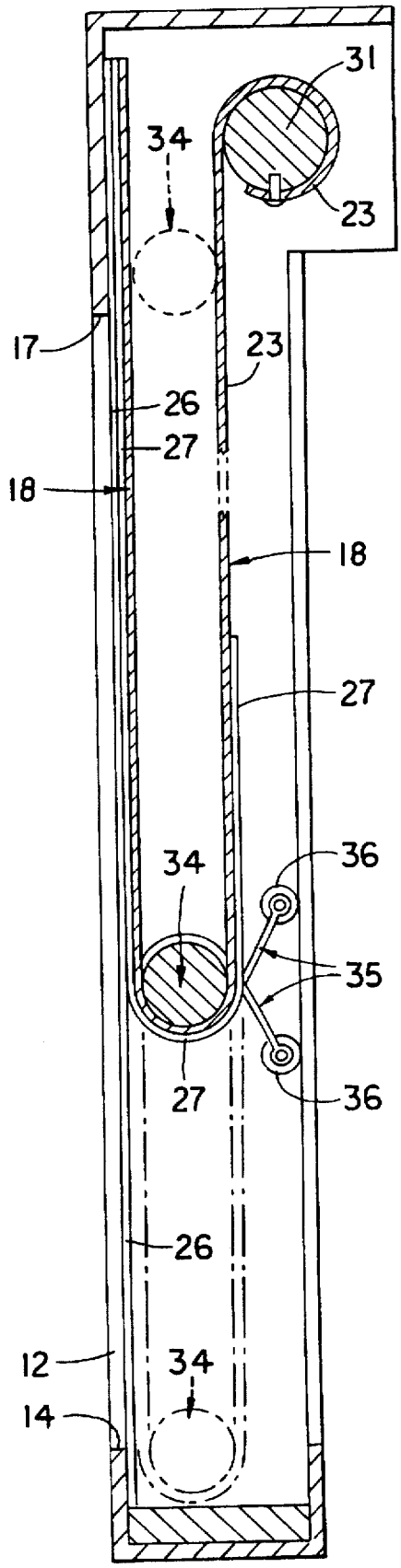
FIG. 2 is a sectional view of the invention taken along line 2—2 of FIG. 1.
Figure 2A:
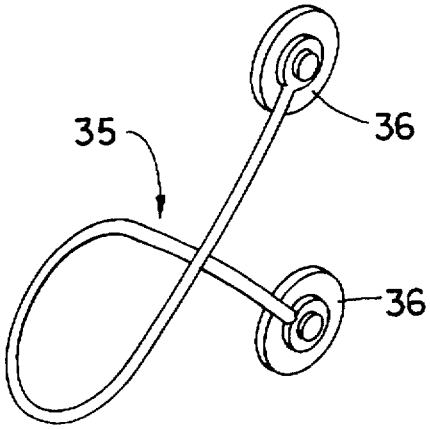
FIG. 2A is a perspective view of the torsion spring shown in FIG. 2.
Figure 3:
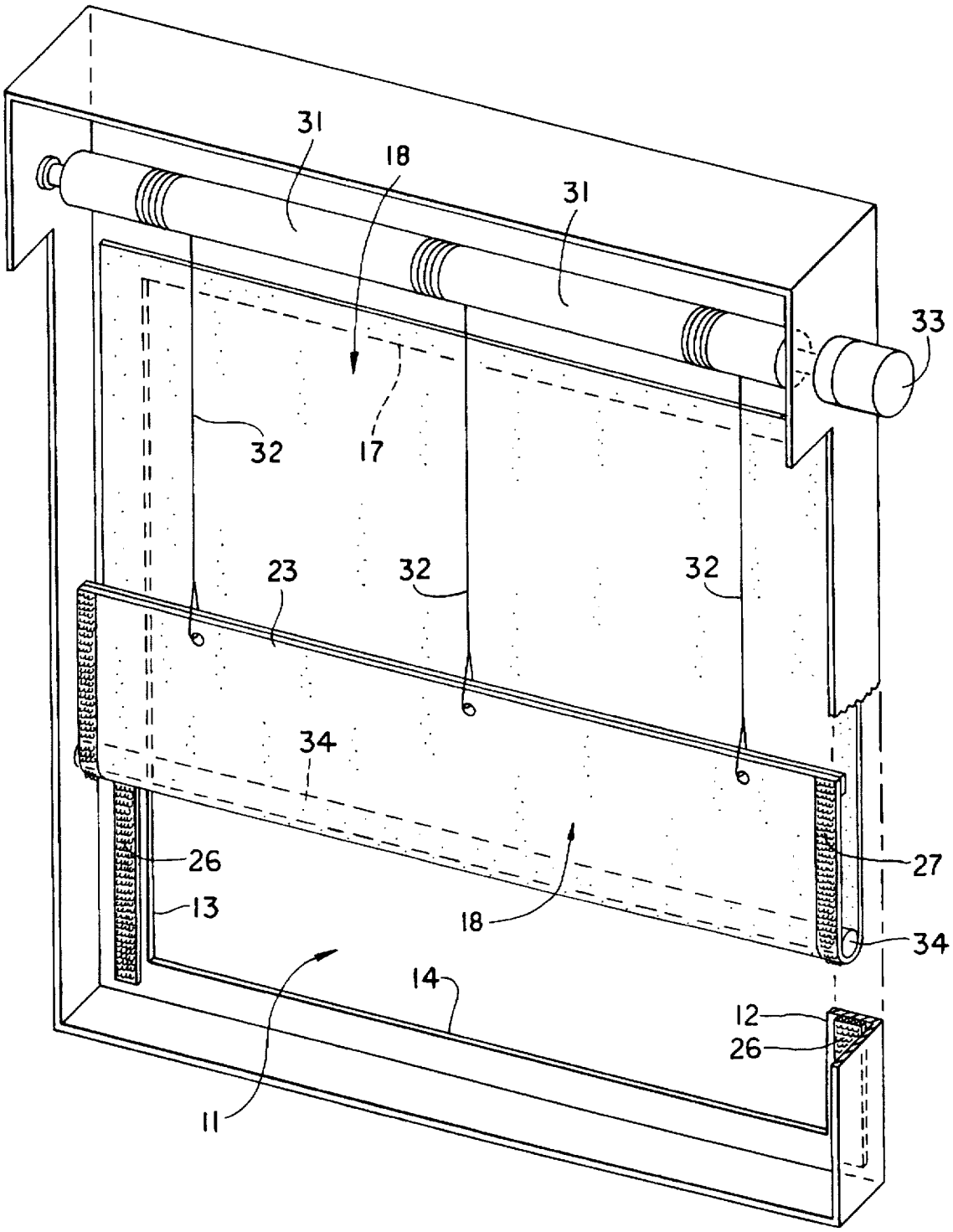
FIG. 3 is a rear perspective view of an alternate drive means.

Upturned end 23 may be directly connected to a transverse take-up pipe 31 mounted for rotation above the tops of margins 12 and 13. Alternatively, as shown in FIG. 3, end 23 may be connected to pipe 31 by cables or straps 32. In this embodiment, the curtain length need only be approximately commensurate in length with the length of the margins. In any case, pipe 31 is driven by a reversible motor 33 attached to a selected means of control and supports upturned end 23. An elongated rod 34, which may be a solid or tubular pipe, is supported within the curve of curtain 18 created by upturned end 23 such that rod 34 is lifted within upturned end 23 as pipe 31 is rotated to wrap end 23 thereon. Rod 34 has sufficient weight to maintain the curtain taut. Thus, as pipe 31 unwraps the curtain or straps from itself, the weight of the rod urges the curtain to a lowered position. It will be appreciated that curtain sides 21 and 22 carrying closure 27 are pressed against complementary closure 26 of the margin as a result of the weight of rod 34, thereby ensuring a sealing connection. As pipe 31 raises the curtain, the lifting force is transferred around rod 34 to provide an opening force to the closures nearly normal thereto, such that they are readily detached. From the forgoing it is easily seen that as pipe 31 rotates, it effectively varies the length of curtain 18 such that rod 34 urges closure members 26 and 27 into sealing engagement. Lateral margins 12 and 13 can have optional channel members 28 and 29 attached thereto such that the ends of rod 34 travel within the channel members, thus preventing the curtain from being pulled away from the portal. Additionally, rod 34 can have a torsion spring 35 mounted at each end to urge rod 34 towards lateral margins 12 and 13 to engage closure members 26 and 27. Torsion springs 35 would preferably have rollers 36 mounted thereon to allow torsion springs 35 to move within channel members 28 and 29 with minimal resistance concomitantly with rod 34 as rod 34 is raised or lowered. Torsion springs 35 would be particularly useful in a vertical embodiment of the present invention, the torsion spring being illustrated in FIGS. 2 and 2A.

In an alternative embodiment shown in FIG. 4, a tension spring 37 can be affixed at one end to lower margin 14 and attached at the other end to a first end of cable 42. Cable 42 preferably travels about a first pulley 43, through rod 34, about a second pulley 44, about a third pulley 45, and is attached at a second end to a spool 46 mounted to pipe 31 such that rod 34 is biased towards lower margin 14 ofthe portal. In this embodiment, rod 34 is hollow and has a bearing plug 47 mounted at each end. Each bearing plug 47 has an aperture therethrough with a pulley 48 mounted therein such that cable 42 travels over pulleys 48 to prevent bearing plugs 47 from rotating with rod 34, the bearing plug with pulley being best illustrated in FIG. 4A. Additionally, pulleys 48 are preferably mounted within the bearing plugs 47 such that cable 42 travels through the axial center of rod 34. As pipe 31 varies the length of curtain 18, the length of cable 42 is concomitantly varied such that as curtain 18 is raised, cable 42 is unwound from spool 46 and as curtain 18 is lowered, cable 42 is wound around spool 46.

Figure 5:
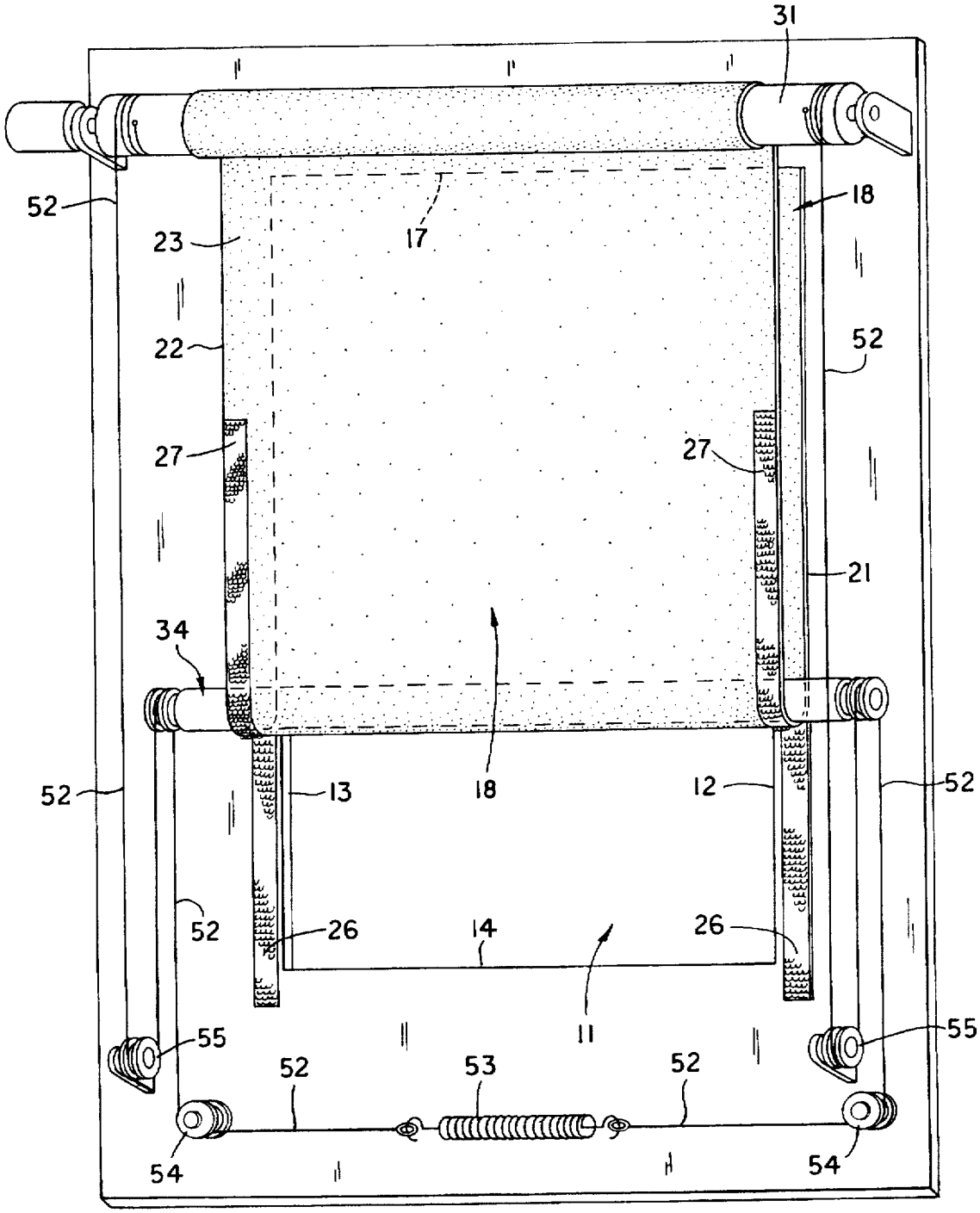
FIG. 5 is a perspective view of another alternative embodiment of the present invention.
Figure 6:
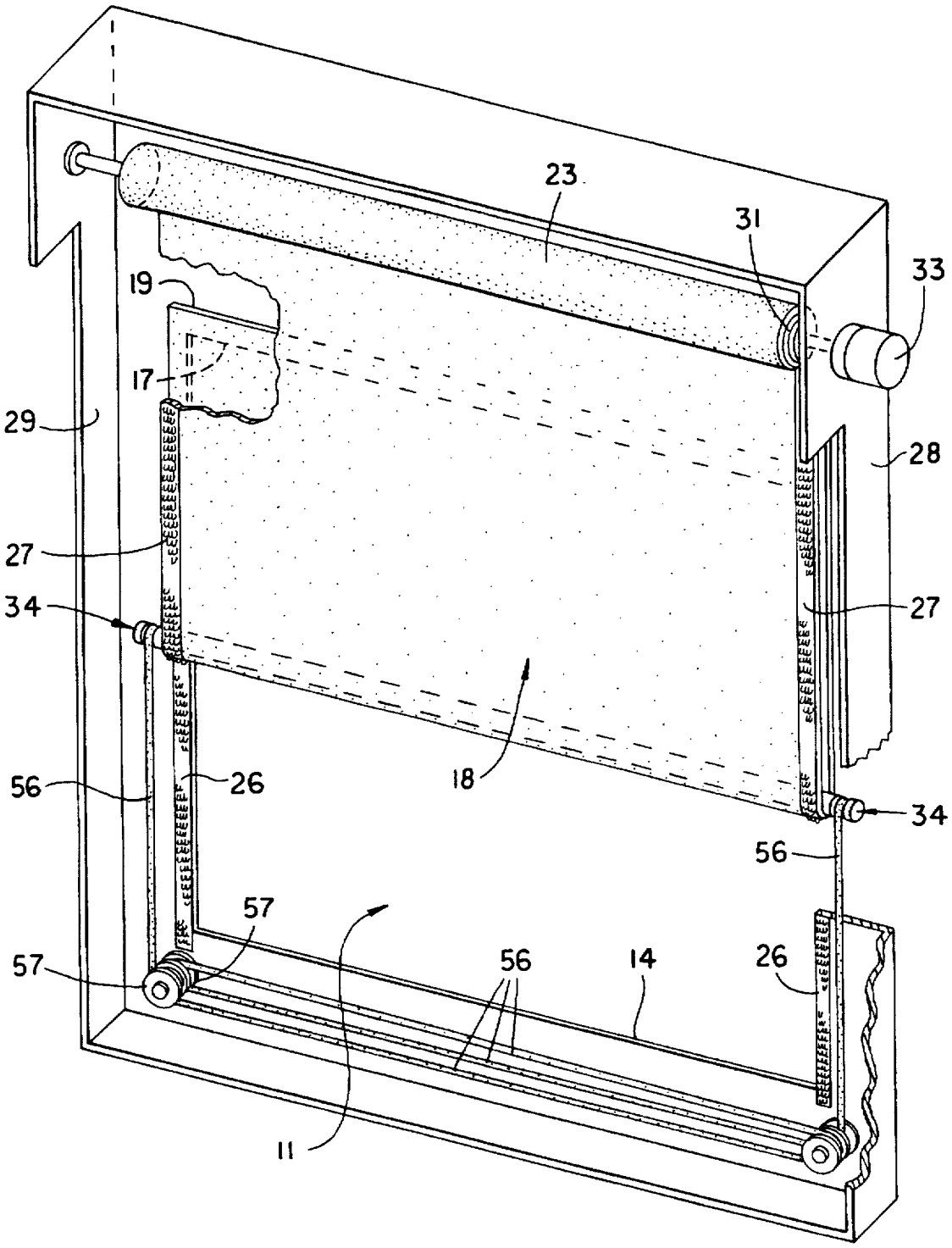
FIG. 6 is a rear perspective view of another alternative embodiment of the present invention.

In another alternative embodiment shown in FIG. 5, a pair of cords 52 can each be affixed at a first end to pipe 31 and at a second end to a tension spring 53, tension spring 53 preferably interconnecting the second ends of cords 52 between two pulleys 54 subjacent lower margin 14. Cords 52 preferably travel about first pulleys 55, about the ends of rod 34, and about pulleys 54 such that rod 34 is biased towards lower margin 14 of the portal. As pipe 31 varies the length of curtain 18, the length of cords 52 are concomitantly varied such that as curtain 18 is raised, cords 52 are unwound from pipe 31 and as curtain 18 is lowered, cords 52 are wound around pipe 31. Alternatively, an elastic cord 56 can be attached to each end of rod 34 and about a plurality of pulleys 57 affixed subjacent lower margin 14 to bias rod 34 towards lower margin 14, as shown in FIG. 6.

Figure 7:
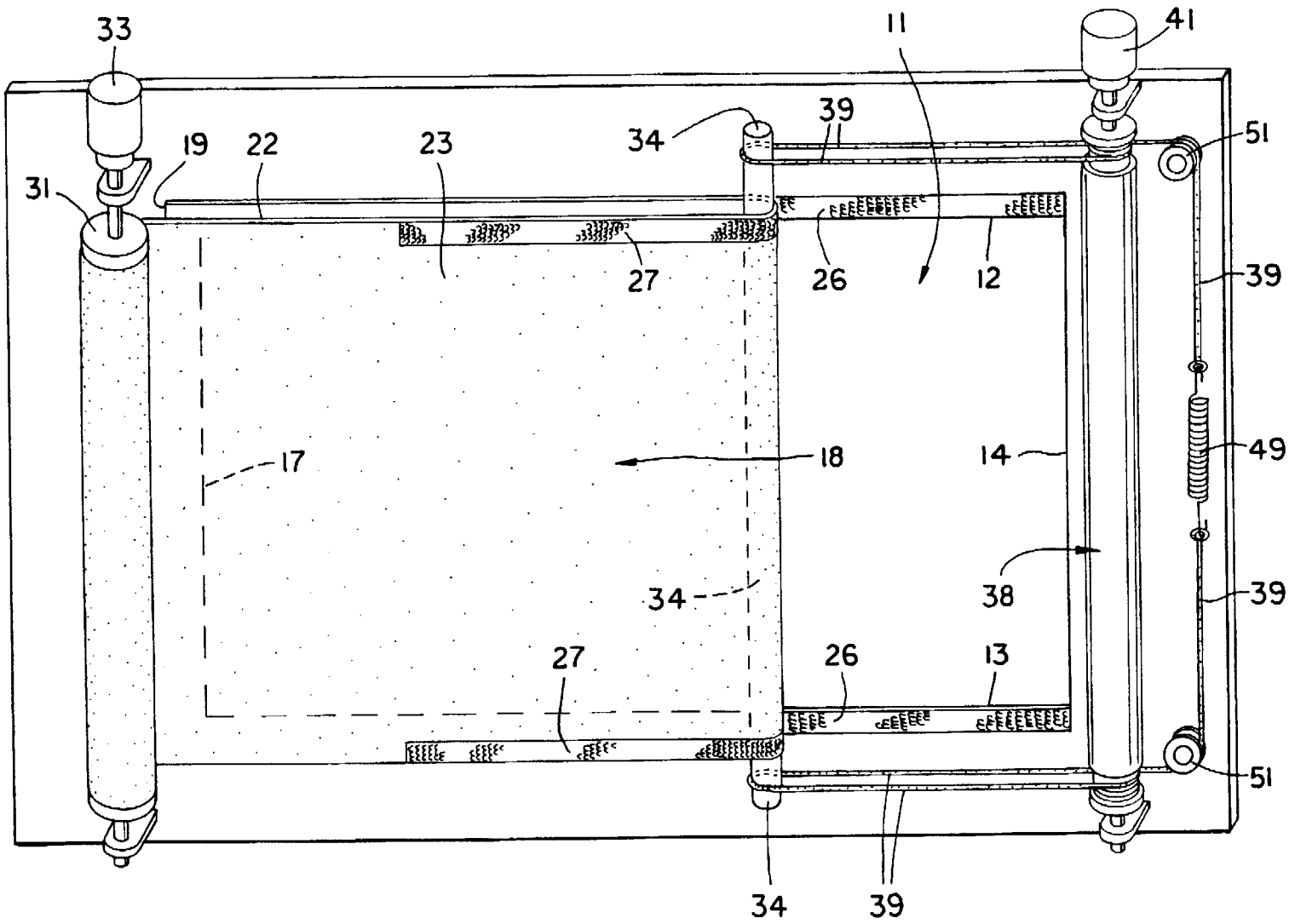
FIG. 7 is an underside perspective view of another alternative embodiment of the present invention.

In another alternative embodiment shown in FIG. 7, a second transverse take-up roller 38 can be mounted for rotation below lower margin 14 with a cord 39 across each end of rod 34. Each cord 39 is preferably mounted at a first end to second roller 38 and at a second end to a tension spring 49, tension spring 49 preferably interconnecting the second ends of cords 39 between two pulleys 51. Second roller 38 is driven by a second reversible motor 41 such that second roller 38 works cooperatively with pipe 31 to raise or lower curtain 18 while constantly maintaining tension on the curtain. Thus, rod 34 has a force biasing it toward the lower margin of the portal which, in turn, keeps the curtain taut and facilitates sealing of closure members 26 and 27 as pipe 31 lowers the curtain. It should be understood that other means can be used to apply force on rod 34 in the direction towards lower margin 14 without departing from the spirit of the invention; however, precaution should be taken to insure that the force is applied equally across rod 34.

The control mechanism may be any of a number of mechanisms depending on the needs of the application of the invention. For example, in a livestock confinement house where temperature control is a necessity, the present invention may be used as a cover for a ventilation fan, and as a variable height curtain over a window. In this situation a temperature controller such as the type manufactured by Hired Hand Manufacturing, Inc. may be attached to each motor for each curtain and constantly monitor the temperature in the house. In this manner, the fans may be uncovered and actuated, and the curtain raised or lowered to meet specific airflow conditions. In another example, the present invention may be used in a greenhouse, having a need to control the amount of sunlight on certain plants during particular months. In this situation, the motor may be controlled by a timer or may be connected to a sensing system connected to a plurality of photocells that incrementally indicate to the motor how much of the curtain should be raised or lowered. Likewise, the opening can be monitored to close during a rain shower. In the simplest case a switch to turn the motor on and off may be provided. Furthermore, limit switches of various kinds may be placed at various locations to further control the movement of the curtain, such that it may eliminate air curtains or the like.

It is ostensibly noteworthy to mention that the present invention is not limited to vertical portals, but can be used with portals ranging from vertical to horizontal or any angle therebetween.

As the portal approaches an angle of 0 degrees (horizontal), the embodiment utilizing the weighted rod becomes less efficient and the embodiment utilizing springs or a second driven roller, shown in FIGS. 4 and 5, becomes more appropriate. Additionally, the present invention is not susceptible to sliding friction between the parts because all of the mating surfaces are contacting each other in a rolling relationship. Therefore, wear on the curtain is minimized, and the drive units do not have to overcome friction to position the curtain. Furthermore, the curtain is not susceptible to jamming due to debris being wedged into sliding engagement with a component since no sliding movement is provided. Accordingly, we have developed a roll-up curtain system that is amenable to a variety of uses in numerous applications from residential to commercial to botanical to agricultural.

It is to be understood that the form of the invention shown is a preferred embodiment thereof and that various changes and modifications may be made therein without departing from the spirit of the invention or scope as defined in the following claims.

Having set forth the nature of the invention, what is claimed is:

1. Apparatus for sealably covering and uncovering a portal comprising:

a) a pair of spaced apart opposing members defining lateral margins of said portal:

b) a flexible curtain having elongated side portions, a first end and a second end each having a dimension commensurate with the separation of the opposing members, with said first end being fixedly attached across said portal at a first end thereof, said second end folded back on itself to define a pocket opening toward said first end;

c) an elongated rod captured within said pocket;

d) a driven roller for biasing said rod toward a second end of said portal to maintain said curtain taut between said first end and said second end of said curtain;

e) means operatively connected to said second end of said curtain for varying the length of said pocket; and f) means for releasably and repeatedly attaching said elongated side portions to said opposing members concomitantly with positioning said pocket at different lengths.

2. Apparatus as defined in claim 1 wherein said driven roller works cooperatively with said varying means to maintain said curtain taut between said first end and said second end of said curtain as said varying means varies the length of said pocket.

3. Apparatus as defined in claim 1 wherein said attaching means includes hook and loop fasteners cooperatively affixed to said elongated portions and said opposing members.

4. Apparatus as defined in claim 1 wherein said varying means comprises a second driven roller mounted adjacent said portal cooperatively connected to said second end of said curtain.

5. Apparatus for sealably covering and uncovering a portal comprising:

a) a pair of spaced apart opposing members defining lateral margins of said portal;

b) a flexible curtain having elongated side portions, a first end and a second end each having a dimension commensurate with the separation of the opposing members, with said first end being fixedly attached across said portal at a first end thereof, said second end folded back on itself to define a pocket opening toward said first end;

c) an elongated rod captured within said pocket;

d) a spring assembly for biasing said rod toward a second end of said portal to maintain said curtain taut between said first end and said second end of said curtain;

e) means operatively connected to said second end of said curtain for varying the length of said pocket; and f) means for releasably and repeatedly attaching said elongated side portions to said opposing concomitantly with positioning said pocket at different lengths.

6. Apparatus as defined in claim 5 wherein said attaching means includes hook and loop fasteners cooperatively affixed to said elongated portions and said opposing members.

7. Apparatus as defined in claim 5 wherein said varying means comprises a second driven roller mounted adjacent said portal cooperatively connected to said second end of said curtain.

8. Apparatus as defined in claim 5 wherein said spring assembly comprises:

(a) a spring mounted to said second end of said portal; and (b) a cord connected at one end to said spring and at an opposite end to said varying means, said cord passing through said rod and about a plurality of pulleys such that as said varying means varies the length of said pocket, said varying means concomitantly varies the length of said cord such that said curtain is continually taut between said first end and said second end of said curtain as said varying means varies the length of said pocket.

9. Apparatus as defined in claim 8 wherein said spring assembly further comprises a bearing plug mounted within each end of said rod, said bearing plug having an aperture with a pulley mounted therein, said bearing plug pulleys mounted such that said cord passes about said pulleys and through an axial center of said rod.

10. Apparatus as defined in claim 5 wherein said spring assembly comprises:

(a) a spring positioned adjacent said second end of said portal; and (b) at least two cords, wherein each of said cords has a first end connected to said spring and a second end connected to said varying means, wherein each of said cords passes about an end of said rod and about a plurality of pulleys such that as said varying means varies the length of said pocket, said varying means concomitantly varies the length of said cords such that said curtain is continually taut between said first end and said second end of said curtain as said varying means varies the length of said pocket.

11. Apparatus for sealably covering and uncovering a portal comprising:

a) a pair of spaced apart opposing members defining lateral margins of said portal;

b) a flexible curtain having elongated side portions, a first end and a second end each having a dimension commensurate with the separation of the opposing members, with said first end being fixedly attached across said portal at a first end thereof, said second end folded back on itself to define a pocket opening toward said first end;

c) an elongated rod captured within said pocket;

d) an elastic cord for biasing said rod toward a second end of said portal to maintain said curtain taut between said first end and said second end of said curtain;

e) means operatively connected to said second end of said curtain for varying the length of said pocket; and f) means for releasably and repeatedly attaching said elongated side portions to said opposing members concomitantly with positioning said pocket at different lengths.

12. Apparatus as defined in claim 11 wherein said attaching means includes hook and loop fasteners cooperatively affixed to said elongated portions and said opposing members.

13. Apparatus as defined in claim 11 wherein said varying means comprises a second driven roller mounted adjacent said portal cooperatively connected to said second end of said curtain.

* * * * *